US005615530A

United States Patent [19]

Kartler

[11] Patent Number: 5,615,530

[45] Date of Patent: Apr. 1, 1997

[54] CORNER FINISHING SYSTEM METHOD

[76] Inventor: Michael J. Kartler, 2850 E. Sierra, Phoenix, Ariz. 85028

[21] Appl. No.: 512,475

[22] Filed: Aug. 8, 1995

Related U.S. Application Data

[62] Division of Ser. No. 199,520, Feb. 22, 1994, Pat. No. 5,440,776.

[51] Int. Cl.[6] ..... E04B 2/00

[52] U.S. Cl. ..... 52/745.09; 52/287.1; 52/288.1; 52/272; 52/741.1; 52/741.13; 52/741.14; 52/742.16; 52/745.1

[58] Field of Search ..... 52/287.1, 288.1, 52/280, 251, 255, 272, 717.05, 717.06, 741.1, 741.13, 742.14, 742.16, 745.05, 745.09, 745.1, DIG. 1

[56] References Cited

U.S. PATENT DOCUMENTS

| | | | |
|---|---|---|---|
| 2,208,227 | 7/1940 | Page | 52/287.1 |
| 2,767,876 | 10/1956 | Mautner | 52/287.1 |
| 3,255,561 | 6/1966 | Cable | 52/287.1 X |
| 3,350,825 | 11/1967 | Rillo | 52/287.1 |
| 5,138,810 | 8/1992 | Kartler | 52/287.1 X |
| 5,505,032 | 4/1996 | Wasserman et al. | 52/287.1 |

*Primary Examiner*—Christopher T. Kent
*Attorney, Agent, or Firm*—Gregory J. Nelson

[57] ABSTRACT

An applicator tool for applying cementitious materials such as joint compound to corners. The tool has a handle and a head which is curved. The handle and head are integrally formed preferably from plastic. A flexible elastomeric blade projects from the forward edge of the head to smooth the compound. A one-piece molded corner cap in a general trihedral shape is provided and when using the tool results in a smooth, uniform finished corner. In use, the one-piece molded corner cap is applied over the corner beads to achieve a snug fit. Cementitious compound is applied over the corner cap and bead resulting in a smooth finished surface with a high quality appearance.

1 Claim, 2 Drawing Sheets

CORNER FINISHING SYSTEM METHOD

This is a divisional of application Ser. No. 08/199,520 filed on Feb. 22, 1994, now U.S. Pat. No. 5,440,776.

FIELD OF THE INVENTION

The present invention relates to the field of construction and more particularly relates to a hand applicator tool and a corner cap for finishing corners and edges with a cementious material such as a joint compound to provide a smoothly finished structure.

BACK OF THE INVENTION

A conventional construction technique involves securing standardized sheets of drywall or gypsum board panels to wall studs and ceiling joists. Abutting edges of the wallboard sections are conventionally taped and smoothed by application of joint compound which is a cementious material, typically a vinyl latex. Smoothing the planar surfaces at the abutting edges of wallboard is a relatively easy task and may be accomplished by use of a flat edged tool such as a wide blade finishing tool or trowel.

Corners and edges present another problem. Accordingly, it is conventional that outside edges are provided with a perforated, bead member ("bull nose") which may be a galvanized metal or plastic strip which is secured to the abutting panels by mechanical fasteners. The corners are finished by manual application of cement or compound to the corner by trowels or various devices. At a corner, a corner cap is usually first placed beneath the converging strips. The strips are flange-like and overlap the corner cap. The corner cap has a spherical surface. It is necessary that the overlapping beads be secured in place in order to secure the corner cap in place. To finish an outside corner in a satisfactory manner, the corner cap and strips are covered with a coating of compound or cementious material. It will be appreciated that achieving an aesthetically acceptable corner which is uniformly radiused or rounded requires both practice and skill on the part of the installer. Accordingly, in order to facilitate finishing and to obtain uniformity of result, various specialized tools and devices can be found in the prior art. In some cases, workmen often fashion their own tools by modifying existing trowels. Obviously such an approach is not particularly desirable.

Various patents show specialized wall corner-forming tools. For example, U.S. Pat. No. 2,181,209 discloses a plasterer's bullnose finishing trowel having a blade having a wide straight portion and a curved portion as viewed in cross section. A handle member is secured longitudinally to the blade with its middle being in alignment with the radius of the arc of the curved portion.

U.S. Pat. No. 2,271,285 discloses a putty knife having blades disposed at an obtuse angle with respect to each other with a space between the blades at the apex of the angle with a handle adapted to maintain the blades in position.

U.S. Pat. No. 3,079,622 discloses what is termed an "angle plow" for plasterers for smoothing and shaping plaster in the corners which has blades arranged in a general V-shape.

U.S. Pat. No. 4,669,970 discloses an adjustable hand tool for finishing corners, edges and the like with cementious material to achieve a uniformly rounded configuration. The tool has a backing plate with an indented edge and overlaying the backing plate is a pliable sheet which extends across the indentation.

Various corner constructions can also be found in the prior art. For example, U.S. Pat. No. 3,201,908 shows a corner screed bead for use in forming corners in plaster work at the junction of walls and around windows and door recesses. The bead is formed of plastic material and has first and second flanges joined by a bead of circular cross section extending normal to one another to permit installation in either an inside or outside corner.

U.S. Pat. No. 3,350,825 discloses a trihedral plastic corner piece which is adhesively secured in place.

U.S. Pat. No. 2,279,755 discloses a corner blocking plate which eliminates the necessity of providing a miter in close fitting joint of the base shoe molding at a corner.

While the foregoing patents suggest various approaches to the problem of treatment of corners and edges and the application of cementious materials to such areas, there nevertheless exists a need for an improved tool and corner cap with will facilitate the convenient application of compound to such areas and result in a finished structure which is aesthetically pleasing and uniformly rounded.

OBJECTS OF THE INVENTION

It is therefore a broad object of the present invention to provide an improved hand applicator for applying cementious material to corners and edges to obtain a uniformly contoured finished.

It is another object of the invention to provide an applicator tool which is simple and inexpensive to manufacture and convenient and easy for the worker to use, maintain and to clean.

It is still another object of the present invention to provide a prefabricated corner cap which can be economically manufactured and easily applied over the converging strips without the necessity of taping or adhesives.

It is a broad object of the present invention to provide a construction system including an applicator tool and corner bead which is particularly effective for finishing inside and outside corners and edges with cementious material to provide an acceptable and uniformly finished appearance.

SUMMARY OF THE INVENTION

The applicator tool of the present invention includes an elongate handle having a rounded exterior surface which at one end is provided with an enlarged head which is transversely curved. The handle and the head are preferably integrally formed and may be integrally molded from a suitable plastic such as polyvinylchloride or polystyrene. The inner surface of the applicator head is provided with an elastomeric blade which extends forwardly of the front or working edge of the head to provide a flexible lip at least coextensive with the width of the applicator head. The front or working edge of the lip may be provided with a transverse recess. The tool may be used to apply and smooth finishing compound to both interior and exterior corners and edges. The comer cap is a one-piece construction which also may be suitably molded from a suitable plastic such as polyvinylchloride or polystyrene and is trihedral shaped. Three intersecting ridges converge and the ridges are sized and positioned so that they will snugly engage the ridges on converging comer bead strips so that the cap may be applied after the bead is secured in place. When the compound is applied, particularly when using the tool of the system, the corner tool will glide over the cap and onto the bead strip in a continuous motion making it easier to blend or feather over the edges, resulting in a smooth and quality appearing finished surface.

The above and other objects and advantages of the present invention will become apparent from the following description, claims and drawings in which:

Figure 1:
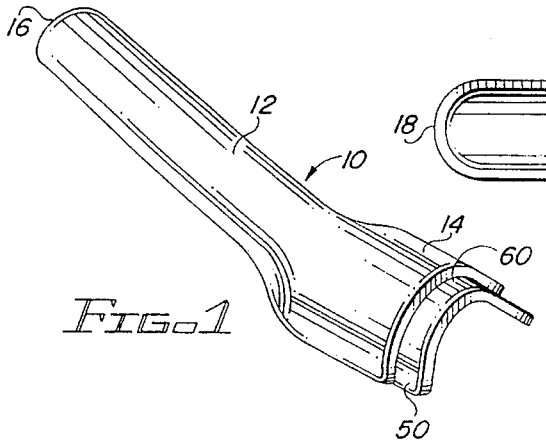
FIG. 1 is a perspective view of the applicator tool of the present invention.

Turning now to the drawings, FIGS. 1 through 6 best illustrate the applicator tool of the present invention which is generally designated by the numeral 10 and which has an integrally formed body consisting of a handle 12 and a head 14. The handle 12 is generally elongate having a curved, generally hemispherical exterior surface 16 which is closed at the distal end 18. The handle has opposite longitudinal edges 20 and 22 and may be a solid piece but is shown as having a wall defining a longitudinally extending hollow interior 25. The forward ends of the handle diverge at 24 and 26 forming enlarged head section 14 which is characterized by opposite longitudinal edges 34 and 36. The head terminates at forward or working edge 35.

Figure 4:
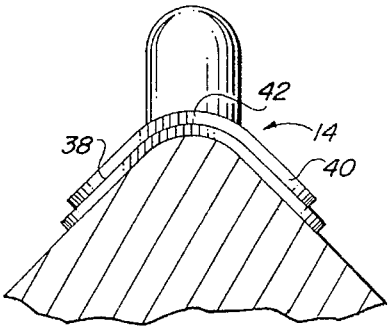
FIG. 4 is a sectional view taken along lines 4—4 of FIG. 3.

As best seen in FIG. 4, the curvature of the head 14 defines opposite inner sides or blades 38 and 40 which are each generally planar and disposed generally at right angles with respect to one another. The medial portion of the head 14 is curved in area 42 providing a gradual radius between the blades 38 and 40.

Figure 3:
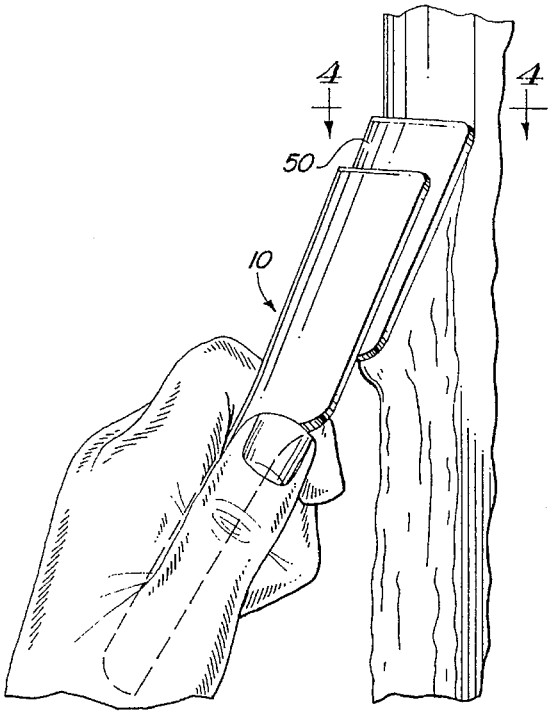
FIG. 3 is a view illustrating the manner in which the tool may be manually used to apply compound to outer corners.

The handle 12 is angularly disposed with respect to the head 14. As best seen in FIG. 3 the angle defined between the upper surface of the head and the upper surface of the handle is an obtuse angle of approximately 150° to 170°. This provides a comfortable orientation of the tool for the workman when using the tool and also allows the workman's hand to easily clear a working surface when the tool is moved along an edge as is illustrated in FIG. 3.

Another significant advantage of the present tool is that it is adapted for easy and inexpensive manufacture. While the tool may be made of various materials, it is particularly adapted to fabrication by plastic fabrication techniques. Further, the tool may be made of a material such as polyvinylchloride or polystyrene and molded as an integral unit as for example by injection molding.

Figure 2:
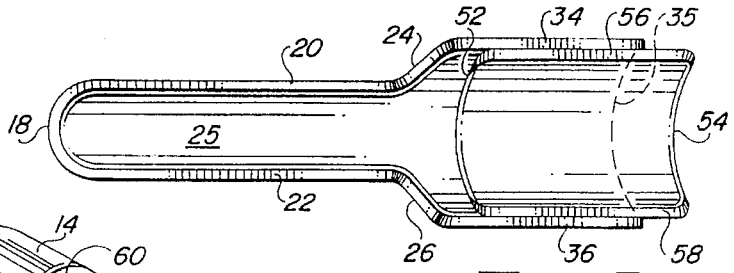
FIG. 2 is a bottom plan view of the application tool of the present invention.

In order to facilitate the application of compound to a work surface and to facilitate the uniform shaping of a corner and edge, a flexible elastomeric blade member 50 is secured to the inner surface of the head. The elastomeric blade 50 may be fabricated from any suitable material such as natural or synthetic rubber and has a rear edge 52, front edge 54, opposite side edges 56 and 58. When applied to the head of the tool, the working edge 54 of the blade extends forwardly of the head approximately ¼" to ½" forming an exposed lip 60. The forward edge 54 may be generally linear extending between the side edges 56 and 58 or is preferably provided with a recess conforming to the front edge of the head as best seen in FIG. 2. The flexible blade extends within the confines of the handle rearwardly to a point terminating slightly forwardly of sections 24 and 26. Similarly, opposite edges 56 and 58 are coextensive with edges 30 and 32 of the handle or may extend slightly outwardly of these edges. The elastomeric blade may be secured to the interior of the head of the tool by a suitable adhesive or other means.

As indicated, the tool is designed to apply compound to inside corners, outside corners and edges of structures having various radii. For most applications, the tool has an approximate overall length of approximately 8". The width of the handle would be approximately 1" and the width of the head approximately 2". In this way, as seen in FIG. 3, the tool fits comfortably into the hand of the workman and when held, the user's thumb is generally positioned along the side of the handle in the area of the diverging sections 24 or 26. Normally, material such as joint compound is applied by the installer from a container in the form of a long narrow trough. Most prior art tools of the type described above are relatively large and are not adapted to use with trough-like containers as the size of the tool prevents the tool from being longitudinally dipped or inserted into the trough. Thus, workers must often insert the tool into the trough of joint material along one side of the trough scooping across the narrow width which makes removal of material difficult. With the tool of the present invention, the size and shape of the tool facilitates its insertion at one end of the trough with the trough being held in the other hand of the worker. The worker may then slide the tool longitudinally along the trough until the desired amount of material has been "scooped" by the head which would be held in the position with the underside of the tool facing upwardly. This facilitates easy separation and removal of the desired amount of material. As best seen in FIGS. 3 and 4, the user can then simply transfer the material to an exterior corner that is being finished and move the tool along the edge with the tool centered on the edge. The flexible working edge will serve to uniformly spread the material as the tool is moved along. The working edge of the elastomeric blade, particularly if it is rearwardly recessed or curved, will serve to conform and smooth the material to the desired shape. Various radii of corners can be finished in this manner. It will be obvious that the tool can be provided in various other sizes to finish larger radius jobs. However, for most interior finishing applications, the tool of the approximate size described above will work well.

Figure 5:
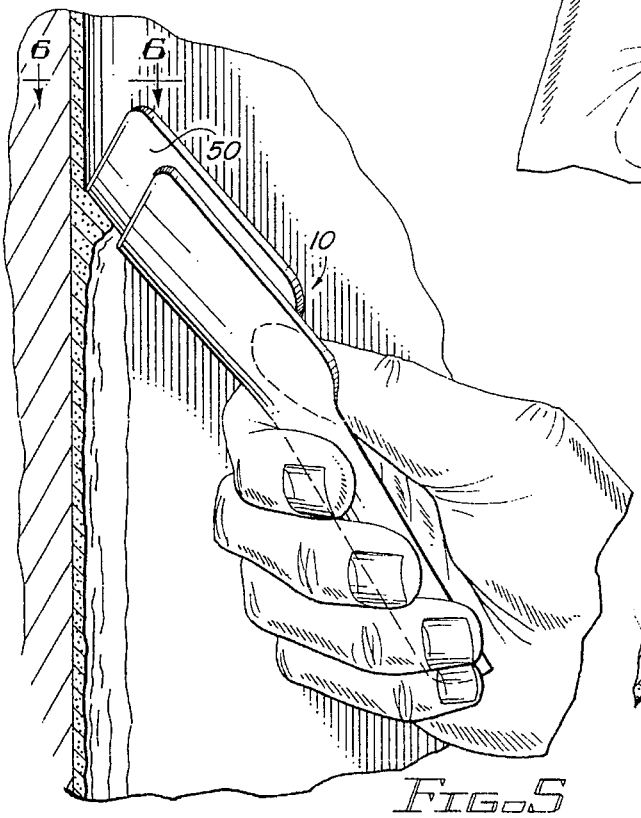
FIG. 5 illustrates the manner in which the tool of the present invention may be manually used to finish an inside corner.
Figure 6:
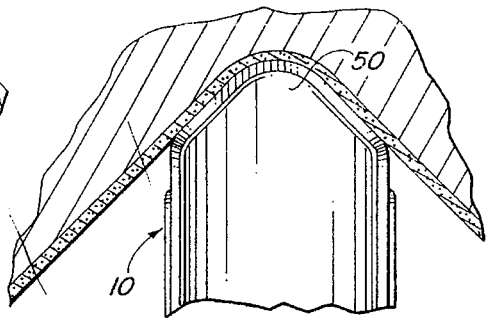
FIG. 6 is a sectional view taken along lines 6—6 FIG. 5.

In addition to finishing exterior corners, the tool of the present invention can also be used to finish inside corners as shown in FIGS. 5 and 6. In this case, the orientation of the tool is reversed as shown in FIG. 5. The convex surface of the flexible blade 50 is positioned facing upwardly and the tool positioned at an angle with respect to the corner. The tool is grasped as shown in FIG. 5 and moved along the corner to smooth the material. In this manner, the compound is smoothed and spread as the material is drawn along the corner.

Figure 7:
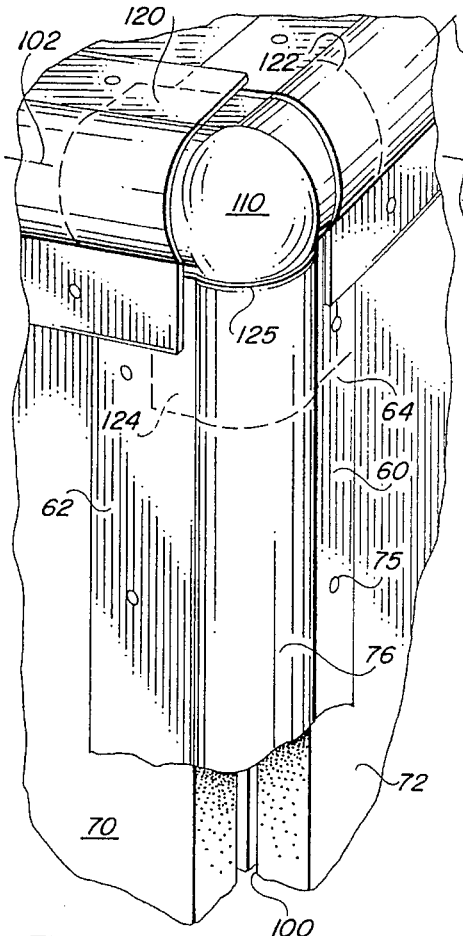
FIG. 7 (PRIOR ART)
FIG. 7 is a perspective view illustrating the typical prior art corner cap construction.

When finishing edges, as for example, the intersection of two vertical panels or a horizontal and a vertical panel, the tool of the present invention is used in the manner described above with respect to the finishing of exterior corners. It is conventional in construction trade that exterior corners are finished by first placing a strip of metal or plastic along the corner. As seen in FIG. 7, the strips which are termed "beads" are represented by the numeral 60 and have a pair of flanges 62 and 64 disposed at generally right angles so that the beads may be secured to the converging wall board sections 70 and 72. The bead is secured by mechanical fasteners and placed in apertures 75 at spaced intervals. The flanges of the bead may be planar members or may preferably have longitudinally extending projections or ribs 76. As seen in FIG. 7, the prior art practice is to position these beads along converging corners. FIG. 7 shows a vertical edge 100 and converging horizontal edges 102 and 104. At the intersection of these edges, a cap 110 is normally first applied and the converging beads applied over the cap. The cap has flanges 120, 122, and 124 disposed at right angles with respect to one another. At the apex of the flanges, a slight bead 125 is provided.

Figure 8:
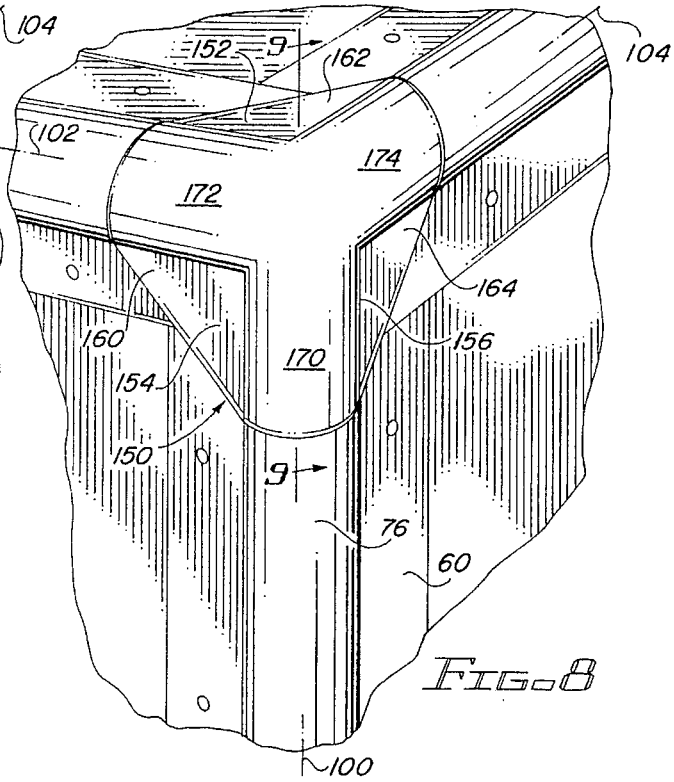
FIG. 8 is a perspective view illustrating the corner cap of the present invention applied at a corner.
Figure 10:
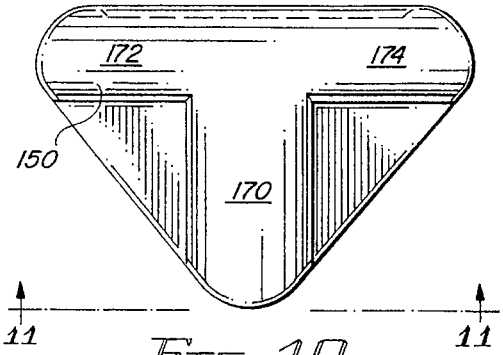
FIG. 10 is a front view of the corner cap as seen in FIG. 8.
Figure 9:
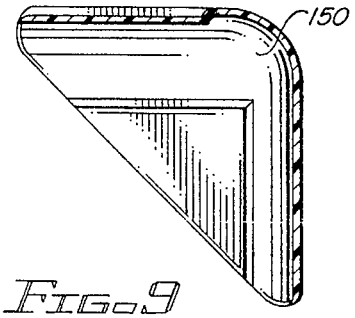
FIG. 9 is a sectional view taken along line 9—9 of FIG. 8.
Figure 11:
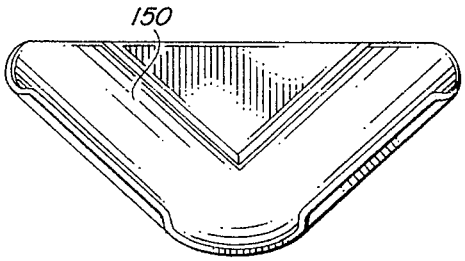
FIG. 11 is a sectional view taken along line 11—11 of FIG. 10.

FIGS. 8 to 11 illustrate an improved corner cap generally designated by the numeral 150 which cap is easy to apply and results in a better-appearing finished product. The corner cap of the present embodiment is molded from a suitable material such as a light weight sturdy plastic such as polyvinylchloride or polystyrene. The cap is generally formed as a trihedral shape having a first generally triangular surface 152, a second generally triangular surface 154 and a third generally triangular surface 156. Trihedral shaped as used herein and as shown in the drawings means that the cap is in the form of a trihedron as the cap has three surfaces and when installed, the three surfaces generally extend from the corner in each of the three planes. In FIG. 8, the cap is shown applied to edges 100, 102 and 104 with edge 100 being a Vertical edge and 102 and 104 being horizontally extending edges. The edges are formed by intersecting or abutting wall board panels. The cap has slightly rounded or radiused ridges 170, 172, 174 in the area extending along the edges 100, 102 and 104. Each of the generally triangular surfaces is provided with a generally triangular recess section 162, 160 and 164.

In use, contrary to conventional construction techniques, the bead strips 60 are placed along the converging edges 100, 102 and 104. Thereafter, the corner cap 150 is positioned on the corner as shown in FIG. 8. The ridges or ribs 170, 172, 174 form a concave depression on the inner side of the cap, helping to support the cap in place by engaging the beads 76 on the converging plastic or metal strips 60. Once the cap is in position, the installation is completed by application of joint compound over the corner cap and converging beads. This is preferably accomplished by use of a tool as described previously and shown in FIGS. 1 through 6. The corner tool of this type will easily glide over the cap and onto the metal strips in a continuous motion evenly applying the compound.

In accordance with the foregoing, it will be seen that the present invention provides a unique hand tool for finishing corners, edges and the like with joint compound or similar cementious material. The present invention also provides a new and improved corner cap which is easier to use and provides a resulting product with a clean, unform finished appearance.

It will be obvious to those skilled in the art to make various modifications, changes and alterations to the invention described herein. To the extent that these various modifications, alterations and changes do not depart from the spirit and scope of the appended claims, they are intended to be encompassed therein.

I claim:

1. A method of constructing an outside common corner at the convergence of three edges of three panels disposed at right angles with respect to one another, said method comprising:

(a) providing a corner cap having a body in a general, integral trihedral shape defining three axes having first, second and third generally triangular faces, and having ribs extending in said faces along the three axes of said trihedral shape;

(b) securing bead strips along the three edges with the strips converging at the common corner;

(c) placing said corner cap over said strips at said corner; and (d) applying cementitious material to said panels, corner strips and corner cap to achieve a uniformly finished appearance.

* * * * *